US005080288A

United States Patent [19]

Shen

[11] Patent Number: 5,080,288

[45] Date of Patent: Jan. 14, 1992

[54] FUEL INJECTION NOZZLE

[75] Inventor: Jim Shen, Greer, S.C.

[73] Assignee: Lucas Industries Public Limited Company, Solihull, England

[21] Appl. No.: 651,448

[22] Filed: Feb. 7, 1991

[30] Foreign Application Priority Data

Feb. 8, 1990 [GB] United Kingdom ..... 9002839

[51] Int. Cl.[5] ..... F02M 51/06

[52] U.S. Cl. ..... 239/585; 251/129.15; 251/129.16; 251/129.21

[58] Field of Search ..... 239/585; 251/129.15-129.22; 335/126, 131

[56] References Cited

U.S. PATENT DOCUMENTS 3,683,871 8/1972 Barr et al. ..... 123/491
3,949,782 4/1976 Athey et al. ..... 361/394
4,705,219 11/1987 Pagdin ..... 239/585
4,763,626 8/1988 Staerzl ..... 123/73 A
4,807,812 2/1989 Renowden et al. ..... 239/585

FOREIGN PATENT DOCUMENTS 0224464 12/1984 Japan ..... 239/585
2136500 9/1984 United Kingdom ..... 239/585

*Primary Examiner*—Andres Kashnikow
*Assistant Examiner*—Karen B. Merritt
*Attorney, Agent, or Firm*—Fleit, Jacobson, Cohn, Price, Holman & Stern

[57] ABSTRACT

A fuel injection nozzle for supplying fuel to the air inlet duct of a spark ignition engine has a valve member movable to an open position when a solenoid comprising a plurality of layers of wire is energised. A negative temperature coefficient thermistor is connected in shunt with a number of the layers of the wire forming the solenoid.

2 Claims, 2 Drawing Sheets

FUEL INJECTION NOZZLE

This invention relates to fuel injection nozzles for supplying fuel to the air inlet duct of a spark ignition engine and of the kind comprising a valve member movable from a closed position to an open position against the action of resilient means by energisation of a solenoid forming part of the nozzle, the valve member in the open position allowing flow of fuel from a nozzle inlet to a nozzle outlet.

With such a nozzle the period during which the solenoid is energised determines the amount of fuel which is supplied to the engine and the practice therefore is to supply the nozzle with fuel at a substantially constant pressure and to modify the width of the energising current pulses in order to vary the amount of fuel supplied to the engine.

A well known problem with engines which utilise such nozzles is that the engine can be difficult to start when the engine is hot and when it has been stationary for a period of time. In this situation the nozzle will have become heated by the heat from the engine to the extent that the electrical resistance of the wire forming the solenoid will have increased by an amount sufficient to substantially reduce the current flow in the solenoid. As a result the magnetic flux generated by the solenoid will be reduced and the practical effect of this will be that for a given width of the energising voltage pulse, the opening/closing period of the valve member will be reduced and a reduced quantity of fuel will be supplied to the engine making it difficult to start the engine.

It is known in the art to use a material when winding the solenoid, having a low positive temperature coefficient. It is also known to construct part of the solenoid from a material having a negative temperature coefficient. This tends to compensate as the temperature increases, for the positive temperature coefficient. Such materials are however less readily available in wire form and are therefore more expensive.

It is also known to connect in series with the winding, a resistor constructed from material having a negative temperature coefficient in order to provide the necessary compensation. The resistor itself is expensive and it also results in a substantial power loss. The resistor can be mounted within the injection nozzle in which case it tends to add to the heat produced by the flow of current, or it can be mounted exterior of the nozzle in which case a special mounting is required to protect the resistor from damage.

It is also known from GB 979015 to provide in close proximity to the solenoid, a thermistor which is used to provide a signal to the current flow control circuit which supplies current to the solenoid. The signal is indicative of the temperature of the solenoid and is utilised in the control circuit to maintain the value of the current flowing in the solenoid at a predetermined value irrespective of the temperature and therefore the electrical resistance of the solenoid. Such a solution requires at least one additional electrical connection to the nozzle and of course a more complex control circuit. The object of the present invention is to provide a fuel injection nozzle of the kind specified in a simple and convenient form.

According to the invention a fuel injection nozzle of the kind specified is characterised by the provision of a negative temperature coefficient thermistor mounted in the body of the nozzle in close proximity to the solenoid, the thermistor being connected in shunt with a portion of the solenoid.

An example of a fuel injection nozzle in accordance with the invention will now be described with reference to the accompanying drawings in which.

Figure 1:
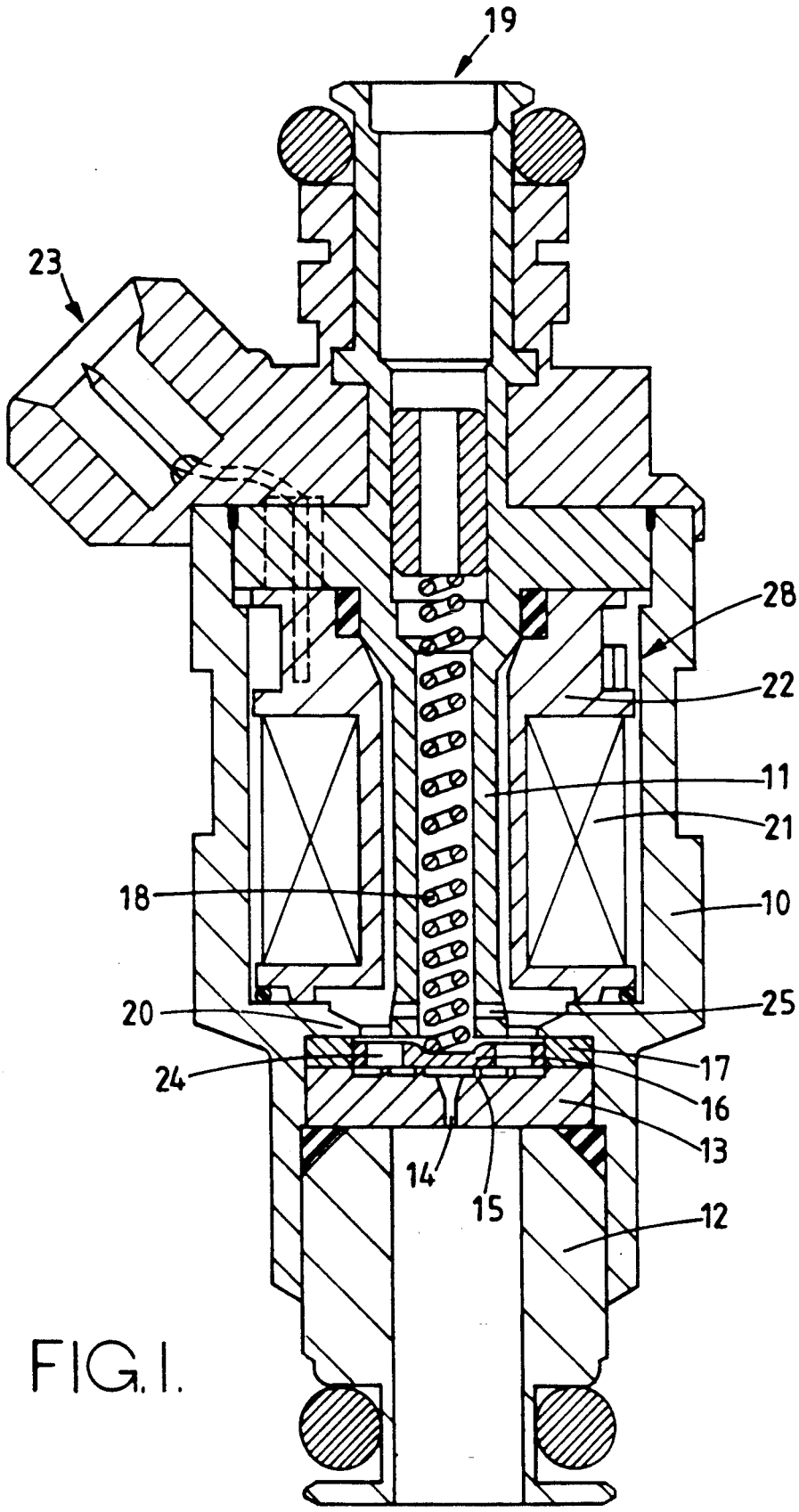
FIG. 1 is a sectional side elevation of the nozzle.

Referring to FIG. 1 the nozzle comprises a body 10 within which is mounted a central core member 11, the core member and the body being formed from magnetic material. Mounted in the body is a tubular outlet 12 against the inner end of which there is located a seating member 13 defining a central orifice 14. The seating member on its face remote from the tubular outlet 12 is provided with an annular seating 15 about the orifice 14 and for cooperation with the seating there is provided a valve member 16 of disc like form and constructed from magnetic material. The valve member is located by means of an annular distance piece 17 and the valve member is biased into contact with the seating by means of a coiled compression spring 18 which extends within a passage formed in the core member and which extends to a fuel inlet 19 connected in use, to a source of fuel under pressure. The end face of the core member forms one pole of an electromagnet, the other pole being defined by an inwardly extending flange 20 defined by the body and in the closed position of the valve member a space exists between the flange and the core member and the valve member.

Surrounding the core member is a solenoid 21 which is wound upon a former 22 which is formed from insulating material. The ends of the solenoid winding are connected to a terminal connecter 23 and which in use is connected by cable, to a control circuit. In operation, when electric current is supplied to the solenoid the aforesaid poles will assume opposite magnetic polarity and the valve member 16 will be lifted from the seating 15. The valve member is provided with through apertures 24 and the core member is provided with radial drillings 25 so that when the valve member is lifted from the seating fuel can flow down the central passage in the core member, through the drillings 25 and the apertures 24 to the outlet orifice 14. The fuel issuing from the orifice is atomised and flows through the tubular outlet 12 into an air inlet duct of the associated engine. A non-magnetic washer (not shown) is trapped between the flange 20 and the distance piece 17, the washer being engaged by the armature to prevent metal-to-metal contact between the valve member and the flange and the core member.

Figure 2:
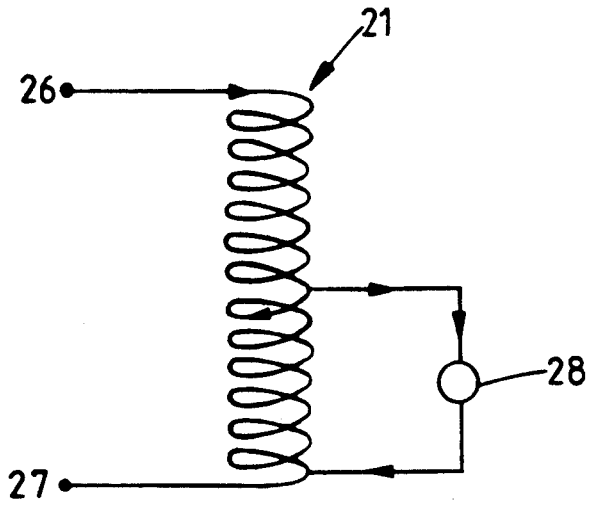
FIG. 2 is an electrical circuit of the nozzle.

The solenoid 21 is diagrammatically illustrated in FIG. 2 and it is formed by a plurality of layers of copper wire tightly wound so as to occupy as small a space as possible. The end of the inner and first layer is indicated at 26 and the end of the outer and last layer is indicated at 27 these ends terminating in the connecter 23. In accordance with the invention part of the solenoid is shunted by a negative temperature coefficient thermistor 28 and as shown in FIG. 1, this is mounted in close proximity to the solenoid so that it will experience substantially the same temperature as the solenoid particularly in the situation where the engine is hot and has been stationary for a period of time. In the example and as shown in FIG. 2, the thermistor is in shunt with the outer layers of the solenoid and therefore one terminal of the thermistor is connected to the lead 27. The thermistor could however be in shunt with the inner layers of the solenoid.

The thermistor has a negative temperature coefficient and therefore as the temperature to which it is subjected increases, its resistance value decreases and thereby as the temperature increases the shunted portion of the solenoid carries less electrical current than the unshunted portion thereof. The total resistance offered by the combined solenoid and thermistor does vary with the temperature, the resistance tending to decrease as the temperature rises. As a result with an increase in temperature the current drawn from the supply also increases and in a particular example the current at 0° C. is 0.926 amps and at 100° C. 1.27 amps. The current in the shunted portion of the solenoid for the same temperature is 0.856 amps and this falls to 0.437 amps at the higher temperature.

Each layer of the solenoid contributes to the total flux produced by the solenoid but as the effective diameter of each layer increases its contribution to the total flux diminishes for the same amount of current flowing. In the example the thermistor 28 is connected in shunt with the outer layers of the solenoid and so the contribution of those layers as the temperature increases, to the total flux is further diminished. However, the current in the unshunted portion of the solenoid increases as the temperature increases and the practical effect is that the total magnetic flux is more or less equal at the two temperatures indicated but diminishes slightly as the temperature increases and then rises again.

Figure 3:
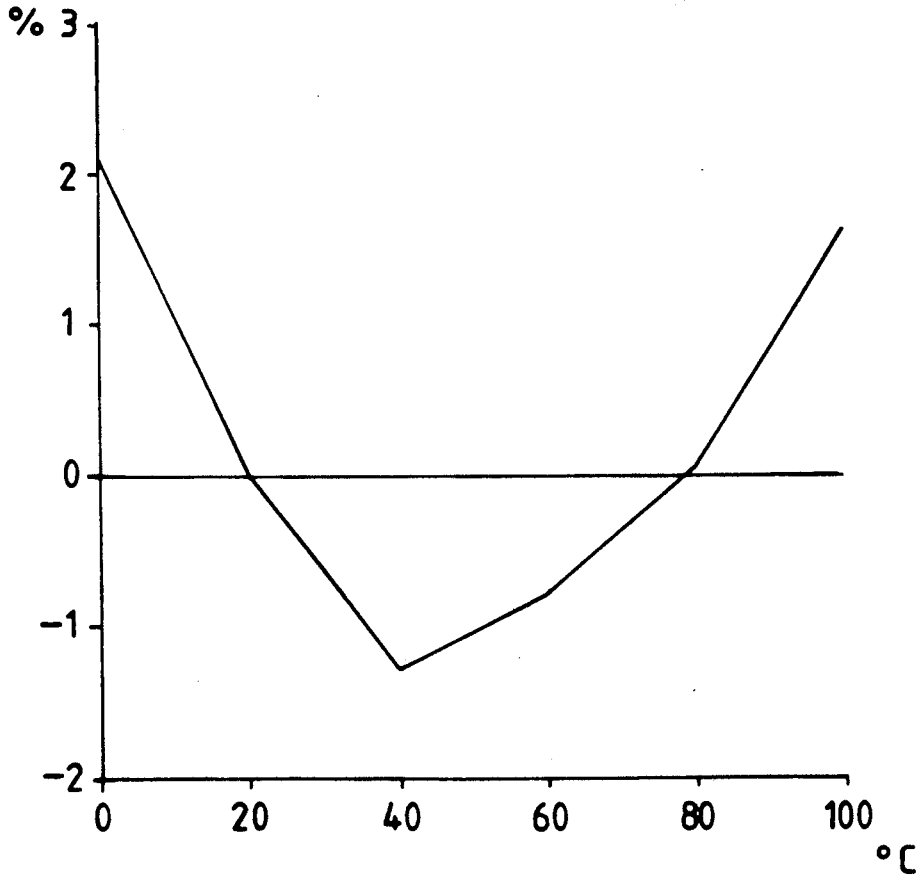
FIG. 3 is a graph indicating the compensation for temperature change achieved in accordance with the invention.

FIG. 3 illustrates the percentage variation in the magnetic flux density in the core member of the nozzle and it will be seen that at 20° C. and 80° C. the flux density is equal, the flux falls between the two temperatures and increases as the temperature increases beyond 80° and as the temperature decreases below 20° . It will be noted however that between the aforesaid two temperatures there is only approximately 1.25% variation in the flux density.

In the particular example the solenoid has 13 layers each comprising 34 turns of copper wire. At 20° C. the total resistance of the winding is 16.5 Ohms. At the same temperature the thermistor has a resistance value of 60.0 Ohms and it is connected in shunt with the last 7 layers of the solenoid. The effect of the thermistor is to reduce the resistance of the solenoid as measured at its terminals to 14.94 Ohms. The thermistor is an NTC thermistor of the type 3D104 produced by Midwest Component Incorporated and its size is such that it can be readily accommodated at the position shown in the injection nozzle.

Tests carried out with engines fitted with injection nozzles modified as described show a significant reduction in the time required to start a hot engine as compared with similar fuel injection nozzles without the thermistor.

I claim:

1. A fuel injection nozzle for supplying fuel to the air inlet duct of a spark ignition engine comprising a valve member movable from a closed position to an open position against the action of resilient means by energisation of a solenoid forming part of the nozzle, the valve member in the open position allowing flow of fuel from a nozzle inlet to a nozzle outlet and by a negative temperature coefficient thermistor mounted in the body of the nozzle in close proximity to the solenoid, the thermistor being connected in shunt with a portion of the solenoid.

2. A nozzle according to claim 1, in which the solenoid comprises a plurality of layers of wire and the thermistor is connected in shunt with at least the outer layer of wire.

* * * * *